US008210269B2

(12) United States Patent
Hudson et al.

(10) Patent No.: US 8,210,269 B2
(45) Date of Patent: Jul. 3, 2012

(54) ARRANGEMENTS, SYSTEMS, AND METHODS FOR PIPE HANDLING

(75) Inventors: Edward H. Hudson, Montgomery, TX (US); James D. Hudson, Conroe, TX (US); Frank A. Gilles, Montgomery, TX (US); Michael J. Steel, Conroe, TX (US)

(73) Assignee: Hydraulic & Fabrication Services, Inc., Conroe, TX (US)

( * ) Notice: Subject to any disclaimer, the term of this patent is extended or adjusted under 35 U.S.C. 154(b) by 316 days.

(21) Appl. No.: 12/549,053

(22) Filed: Aug. 27, 2009

(65) Prior Publication Data

US 2011/0048733 A1 Mar. 3, 2011

(51) Int. Cl.
*E21B 19/00* (2006.01)
*E21B 19/16* (2006.01)
*E21B 19/18* (2006.01)

(52) U.S. Cl. ..... 166/380; 166/77.51

(58) Field of Classification Search ..... 166/380, 166/77.51, 85.1; 414/745.1, 746.3, 746.8, 414/22.62, 22.61
See application file for complete search history.

(56) References Cited

U.S. PATENT DOCUMENTS

| | | | | |
|---|---|---|---|---|
| 3,756,330 | A * | 9/1973 | Russell, Jr. | 173/44 |
| 4,828,050 | A * | 5/1989 | Hashimoto | 175/45 |
| 4,899,832 | A * | 2/1990 | Bierscheid, Jr. | 173/187 |
| 2003/0159854 | A1 * | 8/2003 | Simpson et al. | 175/52 |
| 2009/0053013 | A1 * | 2/2009 | Maltby | 414/22.61 |

FOREIGN PATENT DOCUMENTS

WO WO2006/123934 * 11/2006

* cited by examiner

*Primary Examiner* — Cathleen Hutchins
(74) *Attorney, Agent, or Firm* — Osterrieder, LLC

(57) ABSTRACT

This disclosure provides methods, systems and devices for handling drill pipe. One example embodiment includes a method for handling a drill pipe. The method includes moving the drill pipe by a crane having a grapple, wherein the crane is located on a skid. Further, the method includes receiving the drill pipe within a carriage affixed to the skid, wherein the carriage comprises vises and spinners. Finally, the method includes torquing and spinning the drill pipe within the carriage, whereby the method provides for rapid mating and unmating of the drill pipe for either laying in the ground or possibly into a vehicle for removal to a different location, respectively.

71 Claims, 9 Drawing Sheets

ARRANGEMENTS, SYSTEMS, AND METHODS FOR PIPE HANDLING

BACKGROUND

Directional boring, also called horizontal directional drilling or HDD, is a steerable trenchless method of installing underground pipes, conduits and cables in a shallow are along a prescribed bore path by using multiple pieces of equipment, including one or more drilling rigs and holding vehicles, such as a truck having an empty bed for receiving or supplying the drill pipes. Directional boring is used when trenching or excavating is not practical. Directional boring minimizes environmental disruption. It is suitable for a variety of soil conditions and jobs including road, landscape and river crossings. Installation lengths up to 6,500 feet have been completed, and diameters up to 56 inches have been installed in shorter runs.

Drill pipes, themselves, are generally collared, hollow and threaded for mating and unmating, and may be made of materials such as polyvinyl chloride (PVC), polyethylene, ductile iron, or steel if the pipes, which may be pulled in or out, i.e., through, the drilled hole. Drill pipe is used on drilling rigs to facilitate the drilling of a wellbore and comes is a variety of sizes, strengths and weights but are typically 30 to 33 feet in length. The hollowness allows drilling fluid to be pumped through them, down the hole and back up the annulus. Because it is designed to support its own weight for combined lengths that often exceed 1 mile down into the crust of the Earth, the case hardened steel tubes are expensive, and owners spend considerable efforts to re-use them after finishing a well.

Returning to directional boring, it is often used for installing infrastructure such as telecommunications and power cable conduits, water lines, sewer lines, gas lines, oil lines, product pipelines and environmental remediation casings. Directional boring is also used for crossing waterways, roadways, shore approaches, congested areas, environmentally sensitive areas, and areas where other methods are costlier. Directional boring is used instead of other techniques to provide less traffic disruption, lower cost, deeper and/or longer installation, no access pit, shorter completion times, directional capabilities, and environmental safety.

The method for directional drilling generally comprises a three stage process, wherein the first stage drills a pilot hole on the designed path, and the second stage enlarges the hole by passing a larger cutting tool known as the back reamer. The third stage places the product or casing pipe in the enlarged hole. The directional control capabilities assist the rig operator in making necessary changes in the directions of the drilling head.

HDD is normally performed with the assistance of a viscous fluid known as drilling fluid, which is a mixture of water and, usually, bentonite or polymer continuously pumped to the cutting head or drill bit to facilitate the removal of cuttings, stabilize the bore hole, cool the cutting head, and lubricate the passage of the product pipe.

Location and guidance of the drilling is a very important part of the drilling operation, as the drilling head is under the ground while drilling and, in most cases, not visible from the ground surface. Uncontrolled or unguided drilling can lead to substantial destruction, which can be eliminated by properly locating and guiding the drill head.

There are two types of locating equipment for locating the bore head: the 'walk-over' locating system or a 'wire-line' locating system. In both of the systems a sonde, or transmitter, behind the bore head registers angle, rotation, direction and temperature data. This information is encoded into an electromagnetic signal and transmitted through the ground to the surface in a walk-over system. At the surface a receiver (usually a hand-held 'locator') is manually positioned over the sonde, the signal decoded and steering directions are relayed to the bore machine operator. In a wireline system, this information is transmitted through the cable fitted within the drill string. Both systems have their own merits and depending upon the site requirements a particular system is chosen.

A problem with directional drilling is the amount of equipment necessary to perform the same. An attendant problem includes unnecessary employment of multiple drilling rigs and persons utilized for HDD. What is needed, therefore, are methods, apparatuses and systems that permit using one drill rig and one person for rapid mating and unmating of drill pipes in an HDD environment, a solution for which also resulting in less equipment, personnel, time and overhead costs to perform HDD as compared to the current state of the art.

BRIEF SUMMARY

One example embodiment includes a method for handling a drill pipe. The method includes moving the drill pipe by a crane having a grapple, wherein the crane is located on a skid. Further, the method includes receiving the drill pipe within a carriage affixed to the skid, wherein the carriage comprises vises and spinners. Finally, the method includes torquing and spinning the drill pipe within the carriage, whereby the method provides for rapid mating and unmating of the drill pipe and moving the drill pipe to an off-skid location, which, for instance, includes into the ground or into a holding vehicle, such as a truck with a bed.

Another example embodiment includes an apparatus or system for handling a drill pipe. The apparatus or system includes a skid and a crane attached to the skid, wherein the crane has a grapple. The apparatus or system further includes a carriage that includes vises and spinners arranged in parallel. Yet further, the apparatus or system includes an adjustable center portion of the skid for receiving the drill pipe, wherein the carriage is attached to the adjustable center portion having a length, wherein the carriage is located between a first end and a center of the length, and a lifting mechanism is located between the first end and a second end of the length. Thereby, the crane moves the drill pipe subsequent to either mating or unmating of at least two removably combinable drill pipe sections, which comprise the drill pipe.

BRIEF DESCRIPTION OF THE SEVERAL VIEWS OF THE DRAWINGS

So that the manner in which the above recited features, advantages and objects of the present disclosure are attained and can be understood in detail, a more particular description of this disclosure, briefly summarized above, may be had by reference to the embodiments thereof which are illustrated in the appended drawings.

It is to be noted, however, that the appended drawings illustrate only typical embodiments of this disclosure and are therefore not to be considered limiting of its scope, for this disclosure may admit to other equally effective embodiments.

DETAILED DESCRIPTION OF THE INVENTION

The following is a detailed description of example embodiments of this disclosure depicted in the accompanying drawings. The embodiments are examples and are in such detail as to clearly communicate this disclosure. However, the amount of detail offered is not intended to limit the anticipated variations of embodiments; on the contrary, the intention is to cover all modifications, equivalents, and alternatives falling within the spirit and scope of the present disclosure as may be defined by the appended claims. The detailed descriptions below are designed to make such embodiments obvious to a person of ordinary skill in the art.

Figure 11:
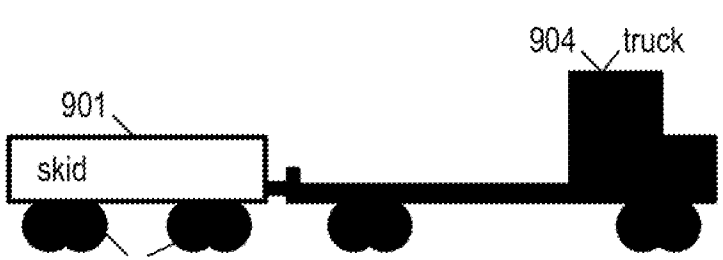
FIG. 11 depicts an example embodiment of a truck having the device and system in tow for transport, whereby the view of the embodiment is a side perspective in accordance with this disclosure.
Figure 10:
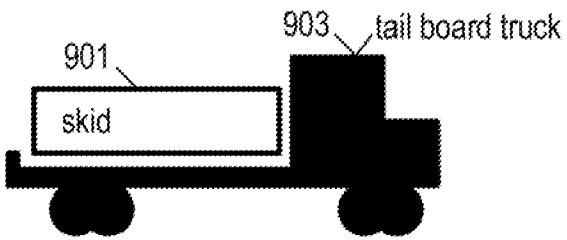
FIG. 10 depicts an example embodiment of a tail board truck holding the device and system from a side view perspective in accordance with this disclosure.

Generally, example embodiments of methods, devices and systems for handling drill pipe in horizontal directional drilling HDD are disclosed. The handling involves unmating or mating, e.g., unscrewing or screwing, sections of drill pipe that collectively comprise a drill pipe as disclosed herein. The present disclosure includes a transportable, self-erecting, and self-sufficient skid, wherein the skid has a crane with a holding means for moving the drill pipe received to or from the skid. The drill pipe is received by the skid by an adjustable center portion located on the skid. The adjustable center portion includes a lifting mechanism to set the angle of placement of the drill pipe on the skid. Along the center portion, the skid has a carriage having vises and spinners arranged in parallel that impart torquing and spinning, respectively, for mating or unmating the sections of drill pipe. The skid's functionalities are operable by a cabin removably attached to the skid and/or one or more remote controls, wherein the cab and remote control(s) are operable through manual or radio controls, for instance, interacting with instrumentation, e.g., computer systems, and equipment located on the skid. The mated or unmated drill pipe made may then be off-loaded to an off-skid position, such as into the ground or into a nearby, holding vehicle, e.g., truck 903,904 as shown in FIGS. 10 and 11, respectively.

Figure 1:
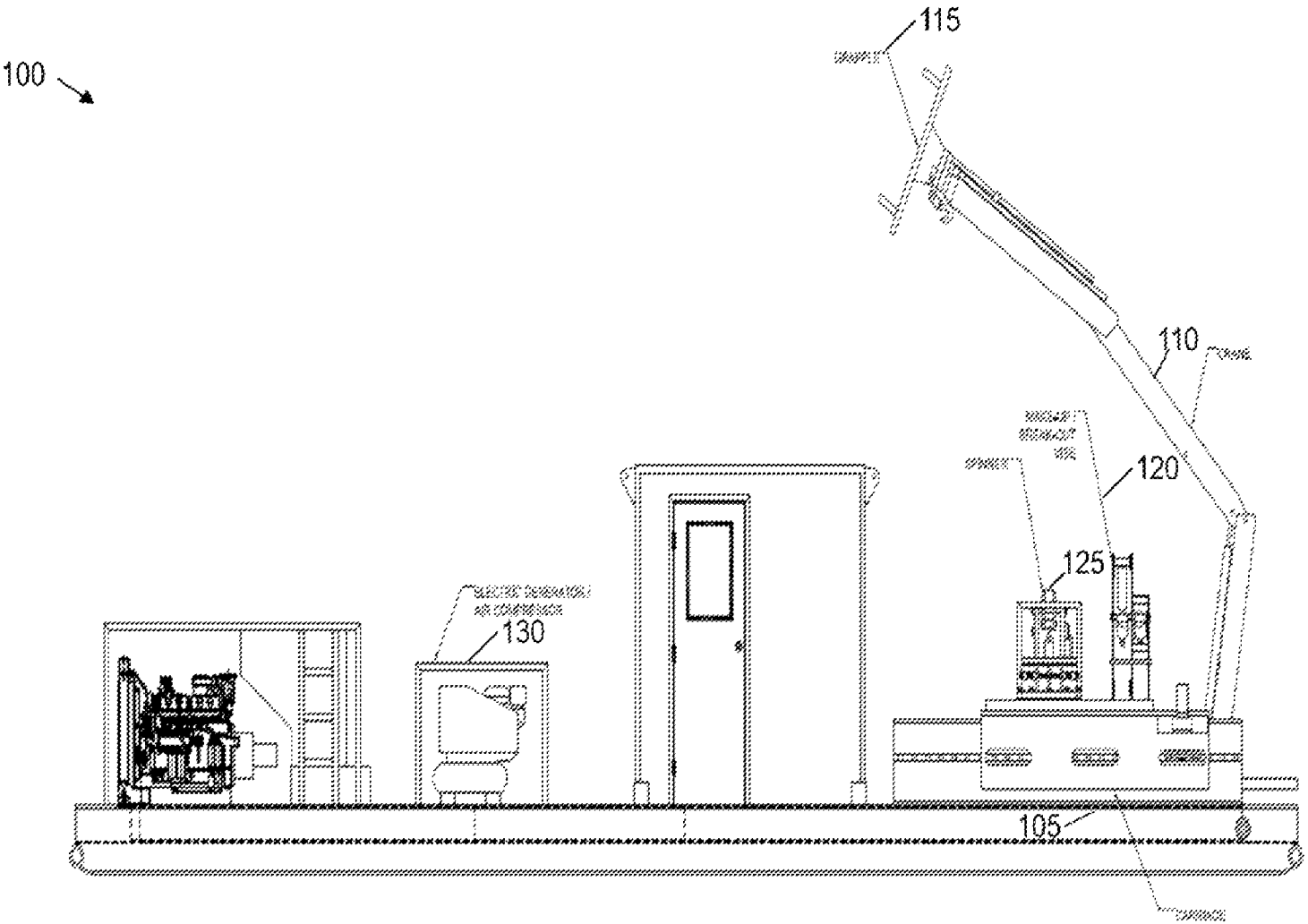
FIG. 1 depicts an example embodiment of a device and system from a side view perspective in accordance with this disclosure.
Figure 2:
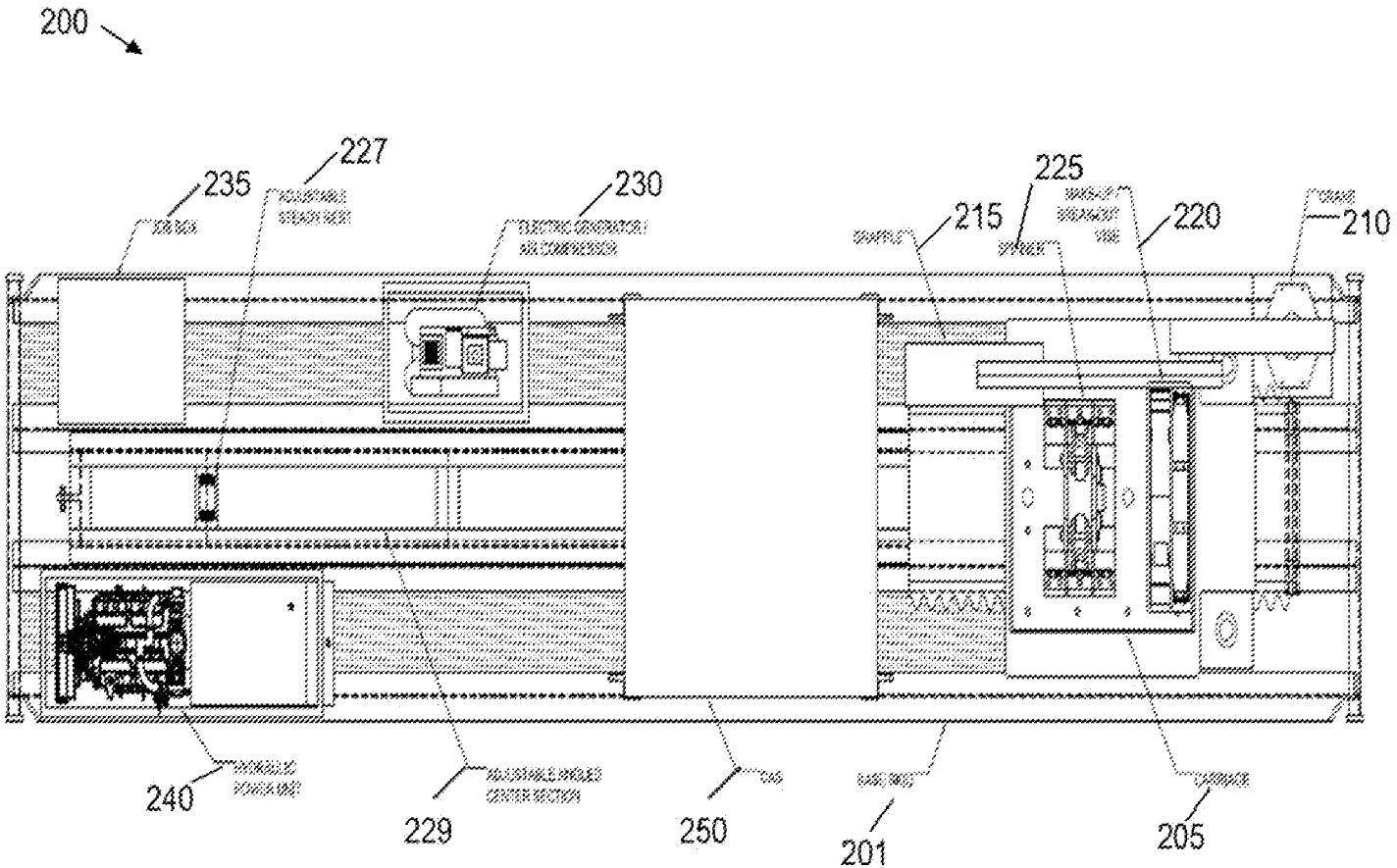
FIG. 2 depicts an example embodiment of a device and system from a top view perspective in accordance with this disclosure.
Figure 12:
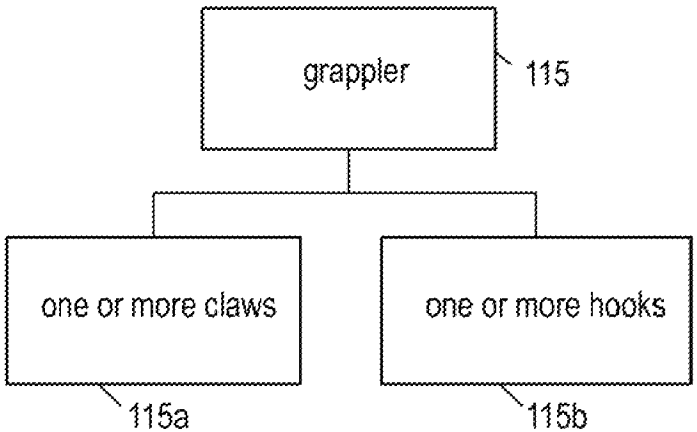
FIG. 12 example grapplers in accordance with this disclosure.

Turning now to the drawings, FIG. 1 and FIG. 2 show a device or system for handling drill pipe in accordance with this disclosure. FIG. 1 shows the device or system 100 from a side perspective and FIG. 2 shows the device or system 200 from a top view. With regard to FIG. 1, the skid shows a crane 110 having a grapple 115. The grapple 115, itself, may, for instance, include one or more claws 115*a*, one or more hooks 115*b*, such as those shown in FIG. 12, or the grapple 115 may be any clenching or catching device capable of securely holding onto drill pipe. The crane 110, for example, includes a knuckle boom crane. Adjacent to the crane 110 on the skid is a carriage 105 including therein both spinners 125 and make-up/break-out vises 120 ("vises") arranged in parallel. The spinners 125 and vises 120 are responsible for providing the spinning and torquing, respectively, for unmating or mating the at least two sections of drill pipe comprising the drill pipe depending on the one of two rotating directions in which they 125, 120 operate in tandem. Moving further on the skid from right to left, the skid also includes, as also shown on FIG. 4, a removable cab 450 having an attachment mechanism 459, e.g., bar, for temporarily mating with the crane's 110 grapple 115 in order to remove the removable cab 450 from the skid 401. FIG. 1 further depicts an electronic generator/air compressor 130 and an unnumbered hydraulic power unit, both of which are optionally located on the skid.

FIG. 2's aerial view of the device or system 200 includes many of the same items located on the skid 201 as depicted in FIG. 1. Here, the removable cab 250 is depicted as being located, at least partially, on top of at least a portion of an unnumbered, adjustable center portion 229, which, as depicted, may be recessed 457 within the skid 201 as more clearly shown with reference to FIG. 4. The device or system 200 further includes one or more steady rests 227 located between a second end and a center of a length of the adjustable center portion 229, whereas the carriage 205 is located between a first end and the center of the length of the adjustment center portion 229. The one or more steady rests 227 are for securely holding in place the end of a drill pipe during operation or non-operation of the mating and unmating caused by the spinners and vises in the carriage 205. Although the exact placement of the various equipment on the skid 201 can be elsewhere than as depicted, a variation within the scope this disclosure, FIG. 2 further depicts a job box 225 and a hydraulic power unit 240 being located on the skid 201.

A more detailed discussion of further and purely example embodiments involving the skid and equipment thereon now ensues with general reference to FIGS. 1-4. Numerical and positional limitations provided within this disclosure are purely illustrative of additional and alternative example embodiments of this disclosure. As previously discussed, the device or system 100, 200, 300, 400 is mounted on a skid 901, as shown in FIGS. 10 and 11, which may also be shipped on one rolling tail board truck 903, as shown in FIG. 10, without a permit in a particular example embodiment. In alternative embodiments, the skid 901 may have wheels 902 located on its bottom side and/or include a connection, such as female hitch for mating with a male hitch on a truck 904. The overall length of the skid may be 40 feet, the overall width may be 102 feet, and the total height may be 9 foot 3 inches. The total weight of the skid with its equipment disclosed herein may be approximately 45,000 pounds. The adjustable center portion of the skid may have a short section of rack beam fabricated in front—near the pivot area—to accommodate the mounting of the vises and spinners. These vises and spinners in the carriage may be advanced up and down the beam for proper alignment with tool joints. There may be one or more steady rests mounted towards the end of the adjustable center portion's length opposite the end of the length having the carriage. The nose of the center section may be hinged so that it can be raised by a lifting mechanism on the integral rigging pipe with a knuckleboom crane having a grapple as discussed herein. The lifting mechanism, such as a hydraulic lift, crank, gears, one or more pins located in arms affixed to the skid and adjustable center portion, permits the adjustable center portion to be raised, pinned, or otherwise selected, such as by a rheostat, interactive digital display, pendulum-style angle indicator, and so forth between 4 and 20 degrees in order to establish the proper angle for working the drill pipe. The knuckle boom crane, hydraulic power unit, job box and electrical generator/air compressor may be temporarily or permanently mounted to the outer corners of the skid. The skid may further include lights mounted on upon telescoping, adjustable poles. The cabin may be removably attached, such as being pinned onto, the skid for shipping purposes, and may be lifted and set off to the side of the skid by the device or system 100, 200, 300, 400 at the jobsite.

The crane may also collapse down to a compact and portable arrangement for shipping, and, once located on the jobsite, has the necessary reach and capacity to offload the cabin to the side of the skid in a location that provides the operator with an excellent overall view of the work area. Removal of the cab from the skid, wherein the removal may operate by either direct or remote control 461 of the crane's instrumentation user computer systems such as that disclosed in FIG. 6, may also backload drill pipe onto a holding vehicle, such as a trailer, parked alongside the device or system 100, 200, 300, 400. The crane may be equipped with a "pipe grapple" attachment, a hook, or otherwise, in order to safely handle the pipe without utilizing a second person for rigging. Remote controls 461 may be of a radio type with the crane and mounted direct controls may be available, wherein either method of controlling the crane's instrumentation for operating some or all of the equipment on or offloaded from the skid as primary or backup. As for radio control operations, such may be accomplished by a "belly box" type controller, which gives the operator total flexibility during jobsite setup. Once all equipment has been located as required, the "belly box" can be set up in the operator's cabin in order to accommodate drill pipe removal operations.

The shipping pins for the cabin may be removed once the skid is properly located on the jobsite. The knuckle boom crane may grab the cabin from the attachment means, e.g., rigging pipe, located on top of the skid, and then lift and set it in the desired position alongside the skid. All hoses and controls can be connected from the cabin to the vises, spinners and the hydraulic power unit. In an example embodiment, once the operator moves the "belly box" controls for the knuckle boom crane into the cabin, all drill pipe handling activities may be controlled from either that cab's new, centralized location with the cab's instrumentation and/or remote control 461 for interaction with the equipment on the skid in communication therewith.

One or more hydraulic power units may be temporarily or permanently mounted to the skid, and may be driven by a six cylinder, air cooled, Deutz diesel engine rated at 115 hp at 2300 rpm (intermittent). The starting system may be 12 V DC, and the engine permits automatic shutdown, for instance, upon low engine oil pressure, high engine oil temperature, and/pr broken belt conditions. The hydraulic power unit is ideally comprised of rugged and dependable components, and is equipped with the necessary filtration and cooling capacity to insure efficient and reliable performance.

A small, gasoline-driven, 13 hp electrical generator/air compressor may be temporarily or permanently mounted to the skid. The dual utility unit will provide 3,000 W of electrical power at 12 V AC and 60 Hz and a pneumatic supply of 17.0 cfm at 90 psi. The electrical generator/air compressor provides electricity, such as for optional lighting 451 and/or 455 of the skid and in the cabin as well as to small electrical hand tools along with the air pressure required to power small, pneumatic hand tools.

Also temporarily or permanently mounted to the skid is an optionally lockable jobsite tool box, which may be sized at 48 inches wide and 30⅜ inches high for storing tools, spare tool dies, spinner parts, etc. that may find practical use during operation and non-operation of the device or system 100, 200, 300, 400.

The vises may be a "top entry" type and equipped with self-energizing jaws that torque into the pipe during make-out or breakout, i.e., mate and unmating, respectively, operations to eliminate the possibility of slippage. There may also be a "V" door installed in the vises to protect the jaws from damage by the drill pipe. The vises are completely versatile and may accept, in example embodiments, drill pipe sizes ranging from 4.5-6.5 inches as well as permit interchangeability of the self-energizing jaw sets for larger or smaller vises if the particular vises do not provide the necessary size ranges for the particular drill pipes at issue.

The hydraulically driven spinner spinners are rugged and accept the same pipe sizes as the vises. The spinners and vices, like other equipment on the skid, may be driven by operator controls, either directly through or via remotely through the cab's instrumentation or the particular equipment's local instrumentation. The spinners and vices in the carriage may move up and down a length of rack beam of the adjustable center portion in order to line up properly with the tool joints of the drill pipe.

Figure 13:
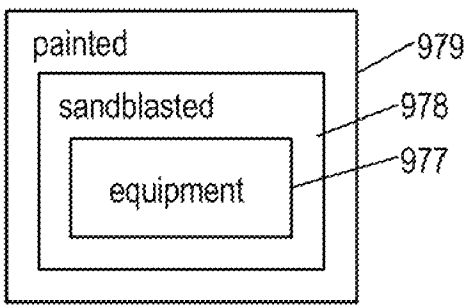
FIG. 13 depicts a sandblasted and painted equipment on the skid in accordance with this disclosure.

As depicted in FIG. 13, the fabricated components of the equipment 977 of the device or system 100, 200, 300, 400 may be sandblasted 978 in accordance with SSPC-10 as well as painted 979 with, for instance, a two-coat epoxy system. Equipment and components thereof that cannot be sandblasted may be cleaned and primered with a suitable tie-coat prior to application of a top coat.

Figure 3:
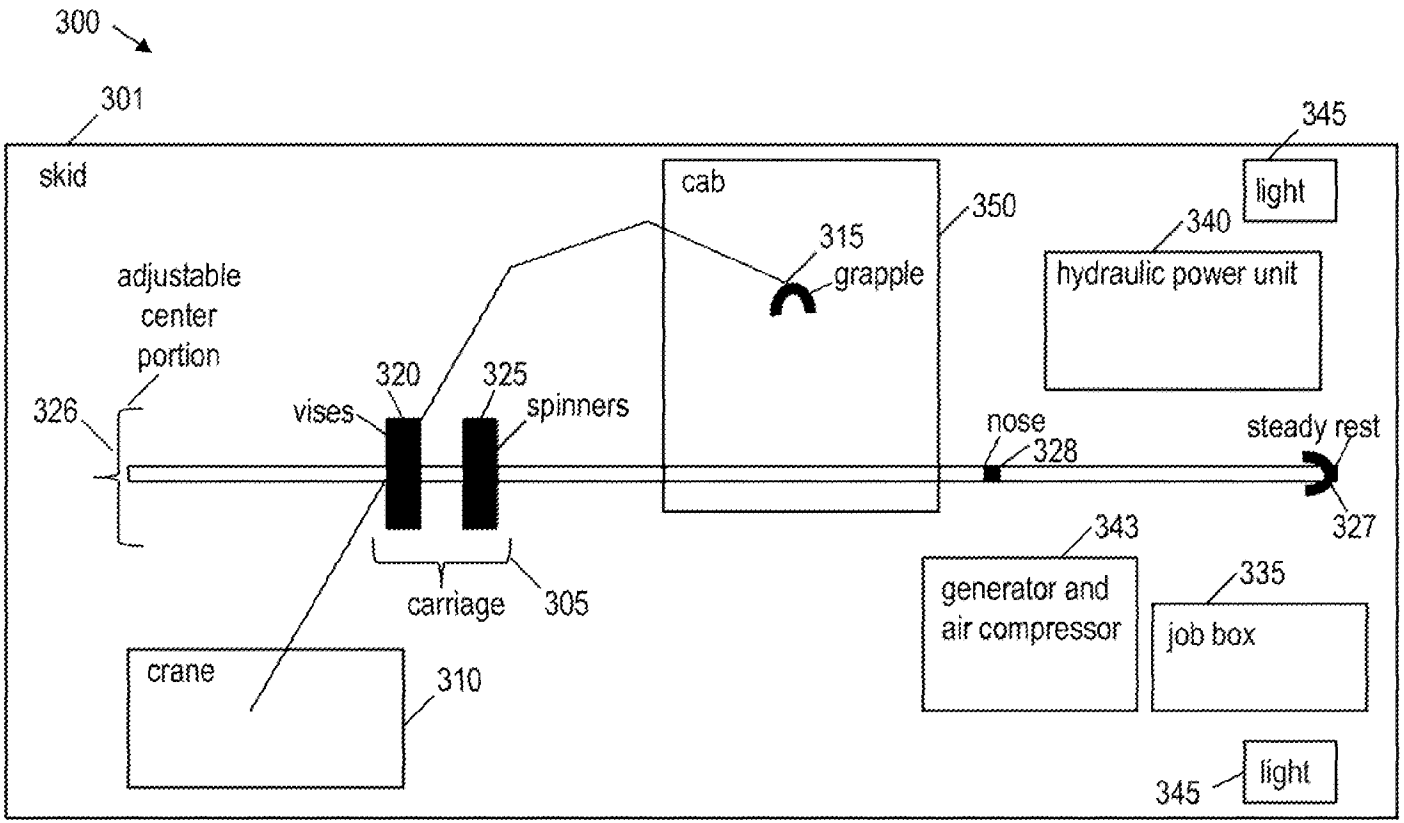
FIG. 3 depicts another example embodiment of a device and system from a top view perspective in accordance with this disclosure.
Figure 4:
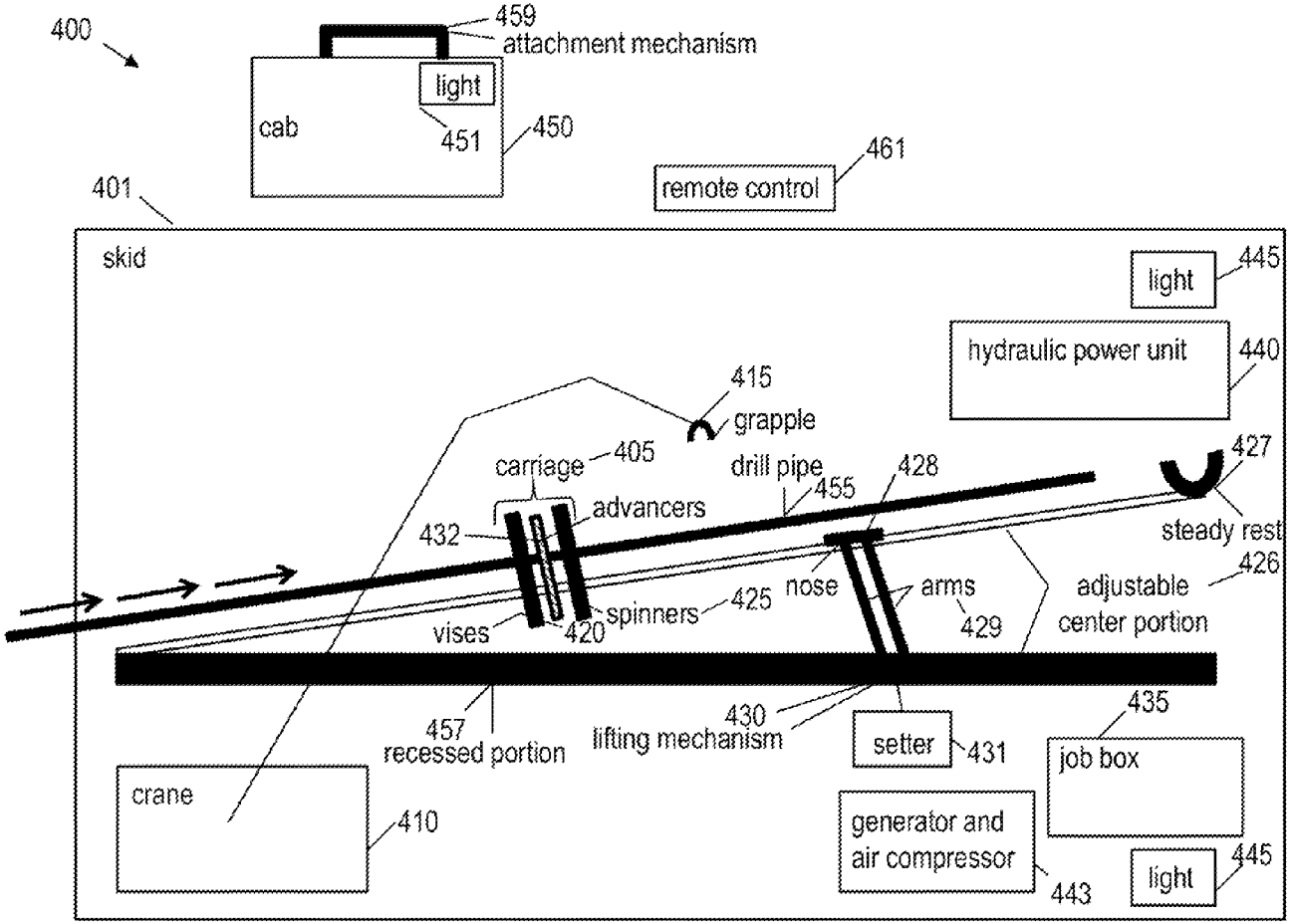
FIG. 4 depicts another example embodiment of a device and system from a side view perspective in accordance with this disclosure.
Figure 9:
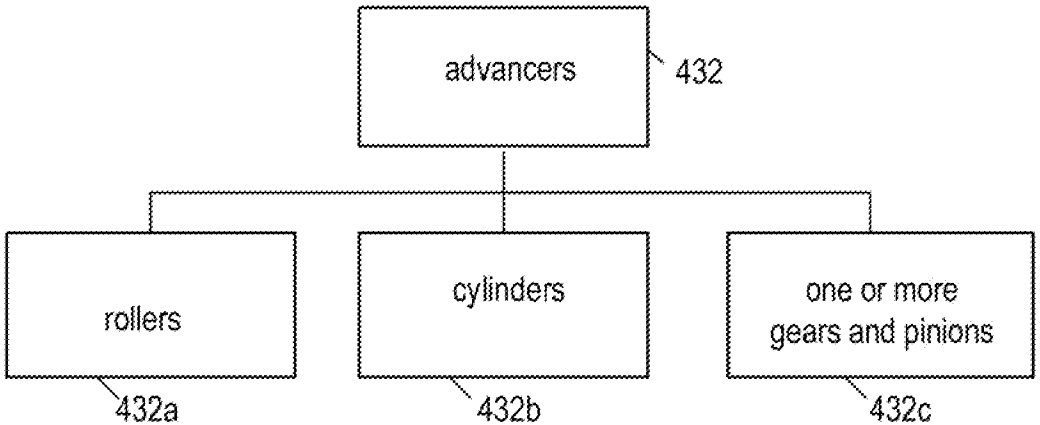
FIG. 9 depicts example advancers in accordance with this disclosure.

With particular reference to FIGS. 3 and 4, example embodiments of a device or system 300, 400 are depicted from top and side views, respectively. FIGS. 3 and 4 depict much of the same as depicted in FIGS. 1 and 2, but in block format and with greater enumeration. As shown in FIG. 3, the skid 301 includes various equipment affixed temporarily or permanently to the skid 301. Such equipment includes the crane 310, 410 having a grapple 350, 450 for temporarily mating with the cab 350 for optional removal from the skid 301, 401, wherein removal of the cab 350, 450 from the skid 301, 401 is shown in FIG. 4. The equipment further includes an adjustable center portion 326, 426 having carriage 305, 405 that includes the vises 320, 420 and spinners 325, 425 for torquing and spinning, respectively, the at least two sections of drill pipe 455 comprising the drill pipe 455 received on the skid, 301, 401. Through operation of the cab's 350, 450 or equipment's instrumentation, via directly and/or remote control(s) 461, the torquing and spinning of the drill pipe 455 in one direction results in mating two sections of drill pipe 455, and, in the opposite of the two directions, the drill pipe 455 is unmated. For incremental management of the directional position of the drill pipe 455 on the skid 301, 401, the carriage 305, 405 further includes advancers 432 within the carriage 305, 405 for retarding the advance of the drill pipe 455 up or down along adjustable center portion 326, 426 of the skid 301, 401. That is, the advancers 432 control the incremental velocity of the received drill pipe. The advancers 432, e.g., rolling on rollers, sliding on cylinders 432*b* and/or gears and pinions 432*c*, as shown on FIG. 9, help ensure proper tool alignment for the torquing and spinning of the drill pipe 455. Positional holding is also aided by one or more steady rests 327, 427 located towards the end of a length of the adjustable center portion's 326 that is the opposite the other end of the length closer to the carriage 305, 405. As previously disclosed, the device or system 300, 400 may also include lights 345, 445, a hydraulic power unit 340, 440, generator and air compressor 343, 443, and a job box 335, 435.

Figure 7:
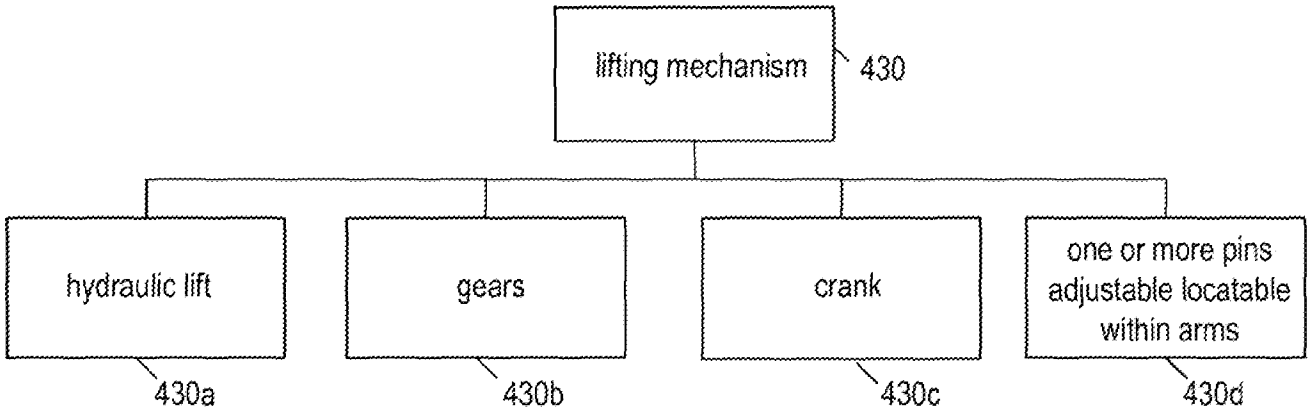
FIG. 7 depicts examples of lifting mechanisms in accordance with this disclosure.
Figure 8:
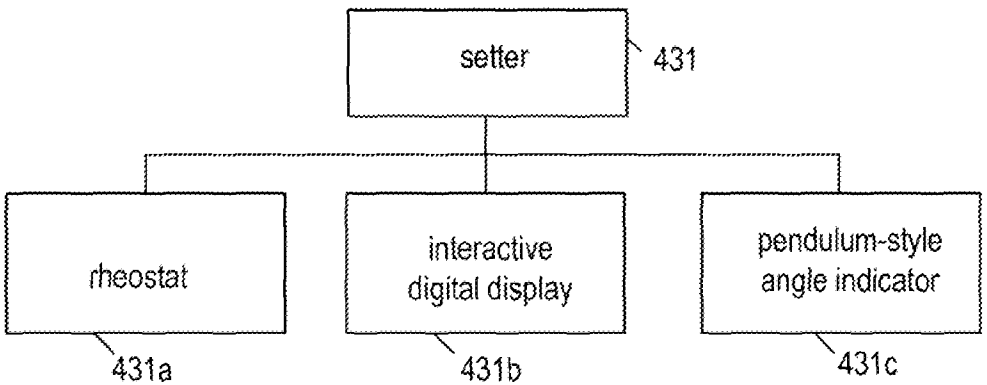
FIG. 8 depicts example setters in accordance with this disclosure.

The skid's 301, 401 equipment may further includes a lifting mechanism 430 to adjust a height of the adjustable center portion 326, 426. The lifting mechanism 430, which may be recessed 457 within the adjustable center portion 326, 426, may include a nose 3289, 4289 wherein the lifting mechanism 430 connects with the adjustable center portion 326, 426, which may include a nose 328, 428 that integrally or affixedly connects to the other portions of the adjustable center portion 326, 426. As previously discussed, the lifting mechanism 430, itself, may be any mechanism that imparts lifting so as to adjust the angle of the adjustable center portion 326, 426 for receipt or holding the drill pipe 455. In various embodiments, the angle of the lifting mechanism 430 may be set, such as through use of a setter 431. The setting may be accomplished automatically or manually through operator control interaction with the skid's associated instrumentation. As shown in FIG. 7, the lifting mechanism 430 may be a hydraulic lift 430*a*, gears 430*b*, a crank 430*c*, or one or more pins adjustably locatable within arms 430*d*, affixed to both the skid 301, 401 and the adjustable center portion 326, 426 at a nose 328, 428 portion as depicted in FIG. 4. In addition and as shown in FIG. 8, further example embodiments may include the setter 431 being a rheostat 431*a*, interactive digital displays 431*b*, pendulum-style angle indicators 431*c*, and so forth in order to set the desired angular position of the adjustable center portion 326, 426.

Figure 5:
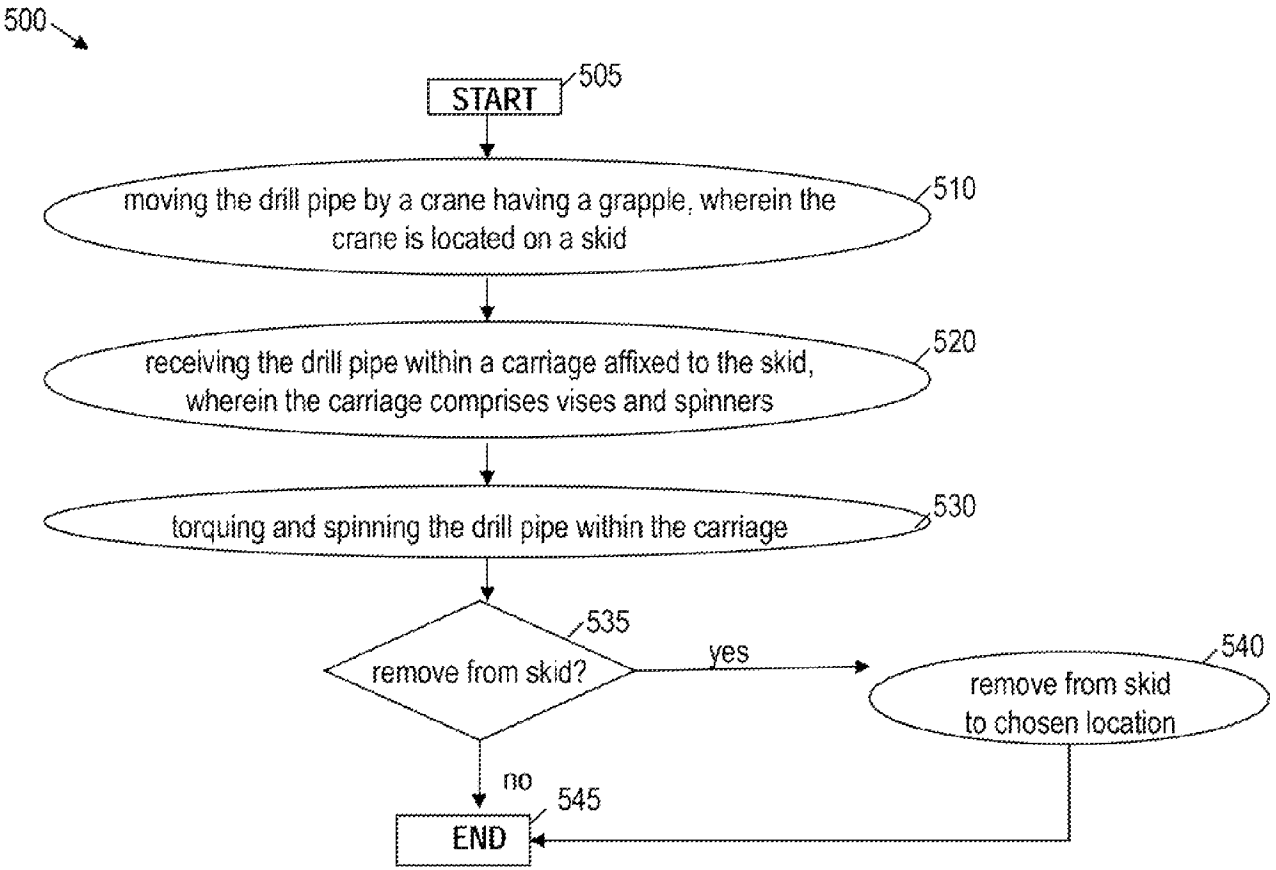
FIG. 5 depicts a flowchart of a method in accordance with this disclosure.

FIG. 5 draws particularized attention to yet another aspect of the disclosure even though the disclosure, as a whole, discloses such. In particular, an embodiment of a flowchart 500 of an example method is disclosed that may be performed by one or more persons. Flowchart 500 starts 505 by a crane having a grapple moving 510 the drill pipe, whether onto the skid or to an off-skid location, and wherein the crane is located on the skid. The flowchart 500 continues by receiving 520 the drill pipe within a carriage affixed to the skid, wherein the carriage comprises spinners and vises for spinning and torquing 530 the drill pipe to permit mating or unmating of drill pipe sections that comprise the drill pipe. Notably, the removably combinable drill pipe sections forming the drill pipe may be pulled or pushed, such as by a drill rig, wherein pushing the drill pipe may be at the unmating of the drill pipe into sections, and pulling may be for the mating of sections that form the drill pipe. The flowchart 500 continues by querying 535 whether to remove the mated or unmated drill pipe from the skid. If yes, the drill pipe is removed to another location, such as into the ground for HDD or onto a holding vehicle, such as a truck 903, 904 as shown in FIGS. 10 and 11, to be stored and/or carried away. Subsequently to this removing 540, as well if the answer to decision block 535 is no, the flowchart ends 545.

Figure 6:
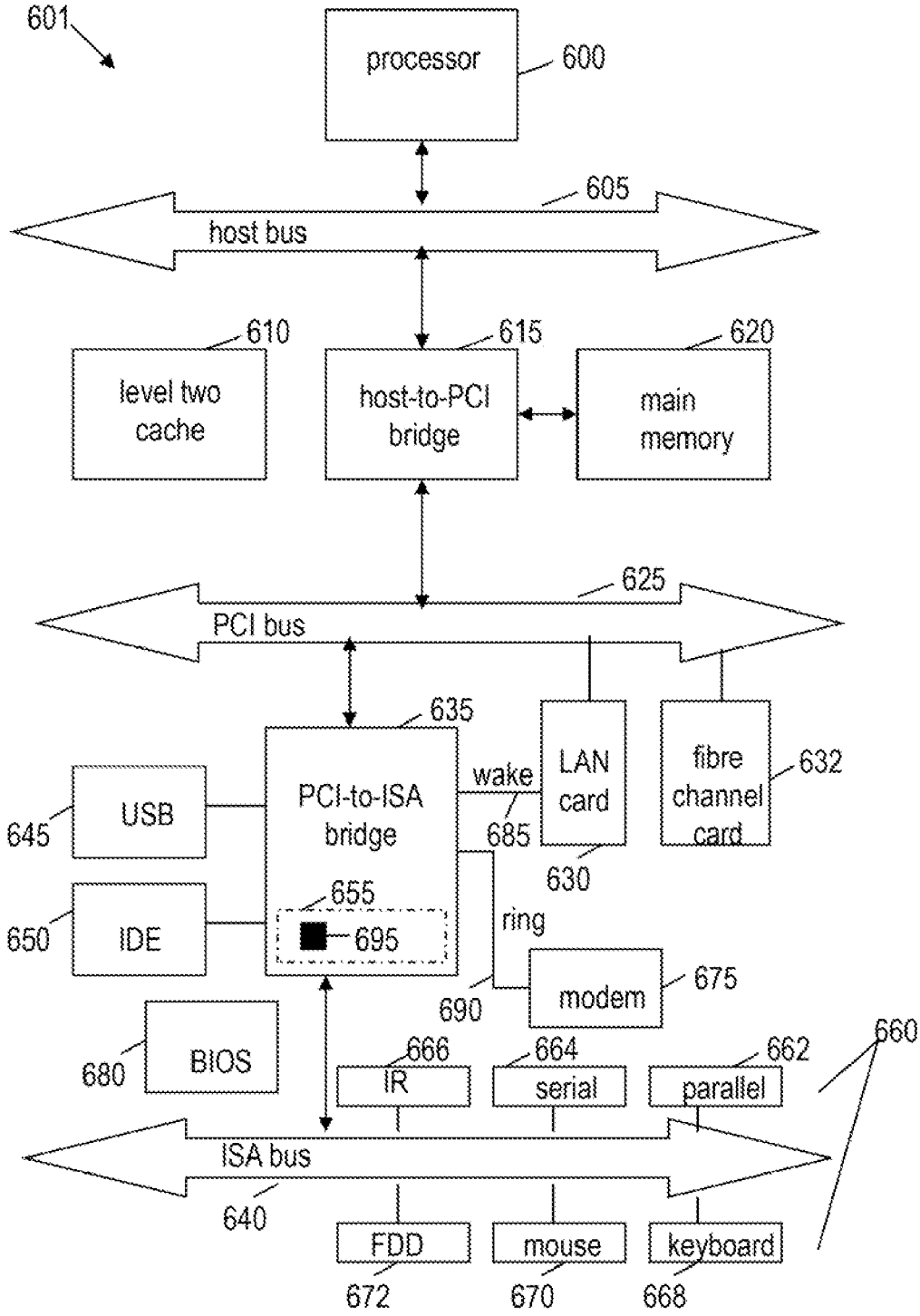
FIG. 6 depicts an example embodiment of a computer system supporting the remote or direct control of instrumentation used for the pipe handling devices, methods and systems in accordance with the disclosed invention.

FIG. 6 illustrates information handling system 601 which is a simplified example of a computer system capable of performing the operations described herein, such as that comprising the instrumentation in the cab and/or on or in association with any of the various equipment on the skid, wherein, regardless of location, may be controlled via direct user control, such as by pushing buttons or selecting menu items on one or more graphical user interfaces on a display and/or through use of one or more remote controls 461 in communication with the equipment. Computer system 501 includes processor 600 which is coupled to host bus 605. A level two (L2) cache memory 610 is also coupled to the host bus 605. Host-to-PCI bridge 615 is coupled to main memory 620, includes cache memory and main memory control functions, and provides bus control to handle transfers among PCI bus 625, processor 600, L2 cache 610, main memory 620, and host bus 605. PCI bus 625 provides an interface for a variety of devices including, for example, LAN card 630. PCI-to-ISA bridge 635 provides bus control to handle transfers between PCI bus 625 and ISA bus 640, universal serial bus (USB) functionality 645, IDE device functionality 650, power management functionality 655, and can include other functional elements not shown, such as a real-time clock (RTC), DMA control, interrupt support, and system management bus support. Peripheral devices and input/output (I/O) devices can be attached to various interfaces 660 (e.g., parallel interface 662, serial interface 664, infrared (IR) interface 666, keyboard interface 668, mouse interface 670, fixed disk (HDD) 672, removable storage device 674) coupled to ISA bus 640. Alternatively, many I/O devices can be accommodated by a super I/O controller (not shown) attached to ISA bus 640.

BIOS 680 is coupled to ISA bus 640, and incorporates the necessary processor executable code for a variety of low-level system functions and system boot functions. BIOS 680 can be stored in any computer readable medium, including magnetic storage media, optical storage media, flash memory, random access memory, read only memory, and communications media conveying signals encoding the instructions (e.g., signals from a network). In order to attach computer system 601 to another computer system to copy files over a network, LAN card 630 is coupled to PCI bus 625 and to PCI-to-ISA bridge 635. Similarly, to connect computer system 601 to an ISP to connect to the Internet using a telephone line connection, modem 675 is connected to serial port 664 and PCI-to-ISA Bridge 635.

While the computer system described in FIG. 6 is capable of executing the methods, systems, and devices disclosed herein, this computer system is simply one example of a computer system. Those skilled in the art will appreciate that many other computer system designs are capable of performing the invention described herein. For example, the processor-based device may not use IDEs, PCIs, ISAs, or FDDs, but such processor-based devices are still understood to impart the functionality for the purpose of performing and/or the methods, systems, and apparatuses disclosed herein.

Another embodiment of the invention is implemented as a program product for use with a computer system such as, for example, the systems and methods described herein, which includes FIGS. 1-5. The program(s) of the program product defines functions of the embodiments (including the methods described herein) and can be contained on a variety of signal-bearing media. Illustrative signal-bearing media include, but are not limited to: (i) information permanently stored on non-writable storage media (e.g., read-only memory devices within a computer such as CD-ROM disks readable by a CD-ROM drive); (ii) alterable information stored on writable storage media (e.g., floppy disks within a diskette drive or hard-disk drive); and (iii) information conveyed to a computer by a communications medium, such as through a computer or telephone network, including wireless communications. The latter embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, may be part of an operating system or a specific application, component, program, module, object, or sequence of instructions. The computer program of the present invention typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

While the foregoing is directed to example embodiments of the disclosed invention, other and further embodiments of the invention may be devised without departing from the basic scope thereof, and the scope thereof is determined by the claims that follow.

What is claimed is:

1. A method for handling a drill pipe, the method comprising:

moving, by a crane directly affixed to a skid a cab removably located on the skid;

moving the drill pipe by the crane having a grapple;

receiving the drill pipe within a carriage directly affixed to the skid, wherein the carriage comprises vises and spinners arranged in parallel;

torquing and spinning the drill pipe within the carriage; and whereby, the method provides for rapid mating and unmating of the drill pipe.

2. The method of claim 1, further comprising adjusting a height of the carriage located on the skid.

3. The method of claim 2, wherein the adjusting comprises hydraulically lifting the carriage.

4. The method of claim 2, wherein the adjusting comprises setting an angular position of the carriage.

5. The method of claim 4, wherein the setting comprises setting one or more pins within holes located on arms of a center section having the carriage.

6. The method of claim 4, wherein the setting comprises setting a rheostat.

7. The method of claim 4, wherein the setting comprises setting an angular position with a pendulum-style angle indicator.

8. The method of claim 2, wherein the adjusting comprises manually adjusting the carriage.

9. The method of claim 1, further comprising advancing the drill pipe within the carriage.

10. The method of claim 9, wherein the advancing comprises sliding on cylinders.

11. The method of claim 9, wherein the advancing comprises advancing through use of one or more gears and pinions.

12. The method of claim 9, wherein the advancing further comprises controlling, by one or more advancers, a velocity of the receiving.

13. The method of claim 1, wherein the drill pipe comprises at least two removably combinable drill pipe sections.

14. The method of claim 1, wherein the moving comprises moving, subsequent to the receiving, the torquing and the spinning, the drill pipe from the skid to an off-skid location.

15. The method of claim 14, wherein the off-skid location comprises a holding vehicle.

16. The method of claim 14, wherein the off-skid location comprises into the ground.

17. The method of claim 1, wherein the moving comprises moving, prior to the receiving, the torquing, and the spinning, the drill pipe from an off-skid location to the skid.

18. The method of claim 1, wherein the receiving further comprises receiving the drill pipe on one or more steady rests located on a center section having the carriage, wherein the carriage is located between a first end and a center of a length of the center section, and the one or more steady rests are located along the length of the center section.

19. The method of claim 18, further comprising adjusting a position of the one or more steady rests, wherein the position is along the length.

20. The method of claim 1, further comprising pulling the drill pipe by a drill rig.

21. The method of claim 20, wherein the pulling comprises pulling, subsequent to the method, of at least two removably combinable drill pipe sections of the drill pipe having been mated.

22. The method of claim 1, further comprising pushing the drill pipe by a drill rig.

23. The method of claim 1, further comprising pushing the drill pipe.

24. The method of claim 23, wherein the pushing comprises pushing, prior to the method, for unmating at least two removably combinable drill pipe sections of the drill pipe subsequent to the method.

25. The method of claim 1, further comprising operating the method by one or more remote controls in communication with the skid.

26. The method of claim 1, further comprising operating the method from a cab having instrumentation in communication with the skid.

27. The method of claim 1, wherein the method comprises operating the method by a single person.

28. The method of claim 1, further comprising slowing the receiving.

29. The method of claim 1, further comprising transporting the skid having wheels attached to the skid.

30. The method of claim 1, further comprising transporting the skid by attaching to a trailer.

31. The method of claim 1, further comprising powering the method by one or more power units located on the skid.

32. The method of claim 1, further comprising lighting the method by one or more lights located on the skid.

33. The method of claim 1, further comprising lighting a cab by one or more lights located within the cab removably attached to the skid.

34. The method of claim 1, further comprising providing a job box located on the skid.

35. The method of claim 1, further comprising providing an air compressor located on the skid.

36. The method of claim 1, further comprising providing a generator located on the skid.

37. A device for handling a drill pipe, the device comprising:

a skid;

a crane attached to the skid, wherein the crane has a grapple;

a carriage comprising vises and spinners arranged in parallel; and an adjustable center portion of the skid for receiving the drill pipe, wherein the carriage is attached to the adjustable center portion having a nose and a length, wherein the carriage is located between a first end and a center of the length, and a lifting mechanism located between the first end and a second end of the length;

a removable cab located on the skid, wherein the removable cab comprises an attachment mechanism for temporarily mating with the grapple; and whereby, the crane moves the drill pipe to an off-skid location subsequent to mating or unmating of at least two drill pipe sections comprising the drill pipe.

38. The device of claim 37, wherein the removable cab is located, at least partially, on top of at least a portion of the adjustable center portion, wherein said portion is recessed within a top side of the skid.

39. The device of claim 37, further comprising lights located on the skid.

40. The device of claim 37, further comprising lights located on the skid within a cab removably attached to the skid.

41. The device of claim 37, further comprising an air compressor located on the skid.

42. The device of claim 37, further comprising a power unit located on the skid.

43. The device of claim 37, further comprising a job box located on the skid.

44. The device of claim 37, further comprising a generator located on the skid.

45. The device of claim 37, further comprising wheels located on a bottom side of the skid, wherein the wheels impart mobility to the skid.

46. The device of claim 37, further comprising a connection on the skid for removably attaching to a truck.

47. The device of claim 37, further comprising placement of the device on a tail board truck for optional transportation of the device.

48. The device of claim 37, wherein the device is shippable as a constructed unit.

49. The device of claim 37, further comprising one or more steady rests located toward the second end of the length of the center portion.

50. The device of claim 37, wherein at least a portion of the center portion is recessed within a top side of the skid.

51. The device of claim 37, further comprising advancers in the carriage, wherein the advancers control the incremental advancement and velocity of the drill pipe received on the skid.

52. The device of claim 37, wherein the vises torque the drill pipe in one of two directions.

53. The device of claim 52, wherein the one of the two directions is to unmate the drill pipe into the at least two removably combinable drill pipe sections.

54. The device of claim 52, wherein the one of the two directions is to mate the at least two removably combinable drill pipe sections into the drill pipe.

55. The device of claim 37, wherein the spinners spin the drill pipe in one of two directions.

56. The device of claim 55, wherein the one of the two directions is to unmate the drill pipe into the at least two removably combinable drill pipe sections.

57. The device of claim 55, wherein the one of the two directions is to mate the at least two removably combinable drill pipe sections into the drill pipe.

58. The device of claim 37, wherein operation of the device is at least partially controlled by a cab having instrumentation in communication with the skid.

59. The device of claim 37, wherein operation of the device is at least partially controlled by a remote control having instrumentation in communication with the skid.

60. The device of claim 38, wherein the lifting mechanism comprises a hydraulic lift.

61. The device of claim 37, wherein the lifting mechanism further comprises a rheostat.

62. The device of claim 37, wherein the lifting mechanism further comprises a pendulum-style angle indicator.

63. The device of claim 37, wherein the lifting mechanism further comprises a manually adjustable device for setting an angular position of the lifting mechanism at the nose.

64. The device of claim 37, wherein the lifting mechanism further comprises one or more pins within holes located on arms attached a center section at the nose of the adjustable center portion.

65. The device of claim 37, wherein the crane comprises a knuckleboom crane.

66. The device of claim 37, wherein the grapple comprises claws.

67. The device of claim 37, wherein the grapple comprises one or more hooks.

68. The device of claim 37, wherein the off-skid location comprises a holding vehicle.

69. The device of claim 37, wherein the off-skid location comprises into the ground.

70. The device of claim 37, wherein the device comprises sandblasted equipment.

71. The device of claim 37, wherein the device comprises painted equipment.

* * * * *